US010495074B2

(12) United States Patent
Friedrichsen et al.

(10) Patent No.: US 10,495,074 B2
(45) Date of Patent: Dec. 3, 2019

(54) PUMP ARRANGEMENT

(71) Applicant: Danfoss A/S, Nordborg (DK)

(72) Inventors: Welm Friedrichsen, Nordborg (DK); Stig Kildegaard Andersen, Krusaa (DK); Lars Martensen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 291 days.

(21) Appl. No.: 14/930,725

(22) Filed: Nov. 3, 2015

(65) Prior Publication Data

US 2016/0131116 A1 May 12, 2016

(30) Foreign Application Priority Data

Nov. 11, 2014 (EP) ..... 14192638

(51) Int. Cl.
*F04B 1/20* (2006.01)
*F04B 1/22* (2006.01)
*F04B 11/00* (2006.01)

(52) U.S. Cl.
CPC ..... *F04B 1/22* (2013.01); *F04B 11/005* (2013.01)

(58) Field of Classification Search
None
See application file for complete search history.

(56) References Cited

U.S. PATENT DOCUMENTS 2,156,933 A * 5/1939 Alden ..... F02D 1/00 123/367
2,286,301 A * 6/1942 Parsons ..... F02M 41/08 210/108
2,428,809 A * 10/1947 Parilla ..... F01B 3/0005 91/184
3,093,081 A * 6/1963 Budzich ..... F04B 1/20 417/216
3,232,524 A * 2/1966 Rice ..... F04B 27/053 417/246
4,041,843 A * 8/1977 Mischenko ..... B30B 15/24 60/484
4,095,921 A * 6/1978 Hiraga ..... F04B 27/1045 417/269

(Continued)

FOREIGN PATENT DOCUMENTS

CN 102434415 A 5/2012
CN 102947587 A 2/2013

(Continued)

*Primary Examiner* — Peter J Bertheaud
*Assistant Examiner* — Geoffrey S Lee
(74) *Attorney, Agent, or Firm* — McCormick, Paulding & Huber LLP

(57) ABSTRACT

A pump arrangement (1) is provided comprising a driving shaft (2), cylinder drum means (3*a*, 3*b*) fixed to said shaft (2) in rotational direction and having a plurality of cylinders (6*a*, 6*b*), and a piston (7*a*, 7*b*) in each cylinder, each piston (7*a*, 7*b*) having a slide shoe (8*a*, 8*b*) in contact with driving surface means (8*a*, 8*b*). Such a pump arrangement should produce a pressure with low undulations. To this end said cylinder drum means (3*a*. 3*b*) comprise at least a first cylinder drum (3*a*) and a second cylinder drum (3*b*), said cylinder drums (3*a*, 3*b*) being fixed to said common shaft (2) in rotational direction, wherein the cylinder drums (3*a*, 3*b*) are offset with respect to each other in rotational direction.

20 Claims, 2 Drawing Sheets

(56) References Cited

U.S. PATENT DOCUMENTS 4,108,049 A * 8/1978 Lawson ..... F01B 3/0005 91/478
4,361,077 A * 11/1982 Mills ..... F04B 1/24 91/500
4,624,175 A * 11/1986 Wahlmark ..... F01B 3/0047 60/487
5,927,073 A * 7/1999 Ishizaki ..... F04B 1/22 60/487
5,957,666 A * 9/1999 Lee ..... F04B 23/106 417/269
6,361,282 B1 * 3/2002 Wanschura ..... F04B 1/22 417/206
6,487,856 B1 * 12/2002 Ohashi ..... F04B 1/22 60/464
6,494,686 B1 * 12/2002 Ward ..... F04B 1/324 417/199.1
6,779,433 B2 8/2004 Brosch et al.
6,793,463 B1 * 9/2004 Ward ..... F04B 1/324 417/199.1
8,419,381 B2 * 4/2013 Ito ..... F03C 1/0639 417/216
9,429,153 B2 * 8/2016 Dreher ..... F03C 1/0686
2004/0168567 A1 9/2004 Gleasman et al.
2005/0017573 A1 * 1/2005 Achten ..... F01B 3/0038 303/1
2005/0095144 A1 * 5/2005 Shimizu ..... F01B 3/0035 417/244
2006/0090639 A1 * 5/2006 Dong ..... F04B 1/2064 91/505
2007/0022751 A1 * 2/2007 Galba ..... F04B 1/22 60/489
2008/0060510 A1 * 3/2008 Achten ..... F04B 1/2007 92/13
2009/0290997 A1 11/2009 Mehta et al.
2010/0083822 A1 * 4/2010 Shimizu ..... F04B 1/20 91/505
2013/0082000 A1 * 4/2013 d'Artenay ..... B01D 61/025 210/651
2013/0205987 A1 * 8/2013 Dreher ..... F04B 1/324 91/495
2013/0209284 A1 * 8/2013 Dreher ..... F03C 1/0686 417/218
2015/0059328 A1 * 3/2015 Suzuki ..... E02F 9/202 60/419
2015/0064030 A1 * 3/2015 Suzuki ..... F04B 17/03 417/372
2015/0211396 A1 * 7/2015 Tsuji ..... F04B 1/22 92/153
2015/0240637 A1 * 8/2015 Kato ..... F04B 1/02 92/12.2
2016/0348672 A1 * 12/2016 Hemink ..... F04B 1/141

FOREIGN PATENT DOCUMENTS

DE 1 453 671 A1 3/1964
DE 10 2008 007 840 A1 8/2009
EP 2585718 A1 5/2013
GB 1252890 A * 11/1971 ..... F04B 1/2064
WO 2011161178 A1 12/2011

* cited by examiner

PUMP ARRANGEMENT

CROSS REFERENCE TO RELATED APPLICATIONS

Applicant hereby claims foreign priority benefits under U.S.C. § 119 from European Patent Application No. EP 14192638 filed on Nov. 11, 2014, the contents of which are incorporated by reference herein.

TECHNICAL FIELD

The present invention relates to a pump arrangement comprising a driving shaft, cylinder drum means fixed to said shaft in rotational direction and having an plurality of cylinders, and a piston in each cylinder, each piston having a slide shoe in contact with driving surface means.

The invention relates in particular to a pump arrangement which is used to pump water into a reverse osmosis unit which is used to gain, for example, drinking water from salt water.

BACKGROUND

In a pump arrangement having a cylinder drum in which a plurality of cylinders is arranged, the pistons in the cylinders are moved sequentially, i.e. the piston reach their upper dead point not at the same time, but one after the other. Nevertheless, this leads to the effect that the pressurized liquid shows a sequence of pressure pulses or a pressure undulation. In some cases such pressure undulation is not desired.

SUMMARY

The objective underlying the invention is to make the pressure undulation small.

This objective is solved with a pump arrangement as described at the outset in that said cylinder drum means comprise at least a first cylinder drum and a second cylinder drum, said cylinder drums being fixed to said common shaft in a rotational direction, wherein the cylinder drums are offset with respect to each other in the rotational direction.

The pump arrangement now has two or more pump units. Each pump unit operates as piston pump. However, the number of cylinders and pistons can be increased since now two or more cylinder drums are available. When the cylinder drums are offset with respect to each other in rotational direction it can be achieved that the upper dead points of the pistons of the different cylinder drums occur at different times so that the undulation frequency is increased and the undulation amplitude is decreased.

Preferrably said cylinder drums have the same number of cylinders. When two cylinder drums are used, the number of cylinders is simply doubled. When the cylinder drums have the same number of cylinders it is possible to place one cylinder of the first cylinder drum between two cylinders of the second cylinder drum and vice versa.

Preferably said cylinder drums are identical. This makes the construction of the pump arrangement simple. Furthermore, it is easier to have spare parts available.

Preferably said cylinder drums are offset to each other by an angle $\alpha=360°/(N*n)$ wherein N is the number of cylinders in each cylinder drum and n is the number of cylinder drums. When for example two cylinder drums are used and each cylinder drum has 9 cylinders, the offset angle $\alpha=20°$.

In a preferred embodiment said first cylinder drum and said second cylinder drum are located on opposite sides of a port housing. The port housing receives the pressurized liquid from two opposite sides. Although the pressure pulses are not generated at exactly the same times, the force on the port housing produced by the liquid pressures can be balanced.

In a preferred embodiment at least one of said cylinder drums is fixed to said shaft by clamping means. Such clamping means produce a friction sufficient to hold the cylinder drum in a fixed position in rotational direction on the shaft.

A further preferred possibility is that at least one of said cylinder drums is fixed to said shaft by a spline connection. The cylinder drum is held on the shaft by form fit.

In this case, it is preferred that said spline connection comprises a number of splines corresponding to the total number of cylinders of said cylinder drums. This makes it easy to produce the pump arrangement having the desired offset between the different cylinder drums. When, for example two cylinder drums are used each cylinder drum having 9 cylinders the spline connection could have 18 splines leading to an angular extension of one spline of 20°. The angular offset in rotational direction can be realized simply by mounting the cylinder drums in different angular positions on the shaft.

In a further preferred embodiment said shaft has a first polygon outer contour inserted in said first cylinder drum and a second polygon outer contour in said second cylinder drum, said polygon outer contours being offset in rotational direction. The polygon outer contour can be in form of a triangle, of a rectangle or the like. It is only necessary that the polygon outer contour is able to transmit the torque required for turning the cylinder drums when the shaft is rotated.

Preferably a sleeve is arranged between said cylinder drum, said sleeve coupling said cylinder drums in rotational direction. The sleeve has two functions. One function is to define a distance between the cylinder drums in axial direction. The second function is to fix the angular relation between the cylinder drums. Both functions can be easily realized by using a sleeve, i.e. a tubular member which is mounted surrounding the shaft, for example.

In this case it is preferred that said sleeve comprises a first engagement geometry at one end and a second engagement geometry at the other end, said first engagement geometry meshing with said first cylinder drum and said second engagement geometry meshing with said second cylinder drum, said first engagement geometry being offset to said second engagement geometry in rotational direction. The offset angle is that which is desired for the rotational offset between the two cylinder drums. The engagement geometries can easily being machined so that the provision of the sleeve does not dramatically increase the production costs.

Here it is preferred that said engagement geometries each comprise at least a recess wherein a pin is inserted into said recess and in a bore of each of said cylinder drums. This means that the cylinder drums can have the bore or the bores in the same position and the angular is simply realized by providing an angular offset between the recesses on both ends of the sleeve.

The pump arrangement according to the present invention is a piston pump. In a piston pump the piston reciprocates in the cylinder. During the movement of the piston in one direction liquid, in the present case water, is sucked from an inlet. When the piston moves in the opposite direction the liquid is pressurized and outputted with an elevated pressure. Since the piston pressurizes the liquid only during the movement in one direction, the pressurized liquid shows pressure pulses.

BRIEF DESCRIPTION OF THE DRAWINGS

A preferred embodiment of the invention will now be described in more detail with reference to the drawing, wherein.

DETAILED DESCRIPTION

Figure 1:
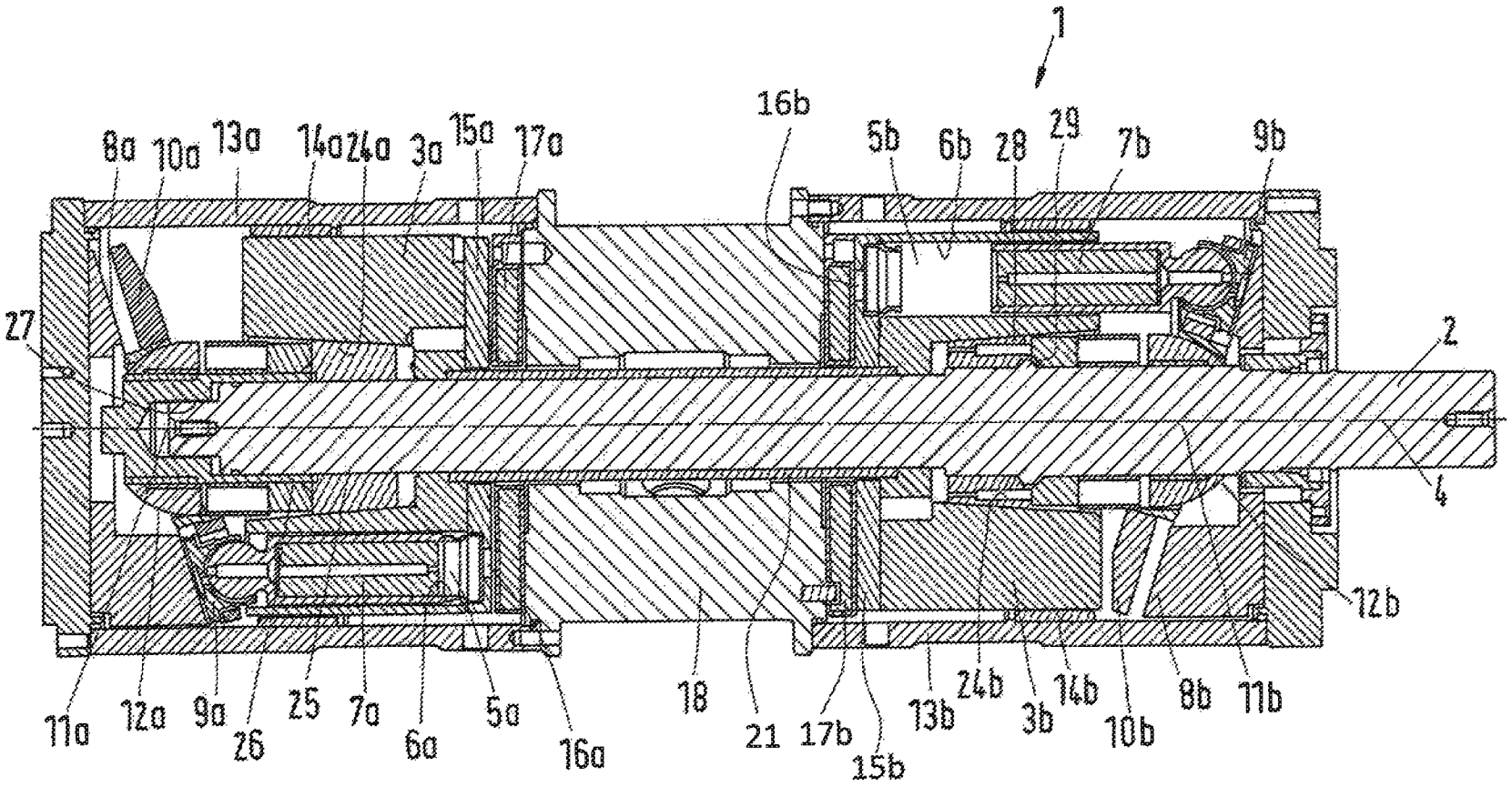
FIG. 1 is a schematic sectional view of a pump arrangement.

A pump arrangement 1 is used for pumping water. It is a water hydraulic machine and comprises a shaft 2 which can be rotated by a motor which is not shown. The shaft 2 is a through going shaft extending over almost the complete length of the pump device 1. A first cylinder drum 3*a* and a second cylinder drum 3*b* are fixed to the shaft 2 in rotational direction and in axial direction of the shaft 2. The axial direction refers to a rotational axis 4 of the shaft 2.

The first cylinder drum 3*a* has a plurality of first pressure chambers 5*a*. Each pressure chamber 5*a* is formed by a first cylinder 6*a* and a first piston 7*a* which is during operation moveable parallel to the axis 4 of the shaft 2. Therefore, the volume of the first pressure chamber 5*a* varies during a rotation of the shaft 2 between a maximum size and a minimum size.

A first swash plate 8*a* is located facing a front face of the first cylinder drum 3*a*. Each first piston 7*a* is provided with a first slide shoe 9*a*. The slide shoe 9*a* is held in contact with the swash plate 8*a* by means of a pressure plate 10*a* swiveling about a first swivel 11*a* during rotation of the first cylinder drum 3*a*. To this end the first pressure plate 10*a* is supported on a first sphere 12*a* slidably mounted and centered on shaft 2.

The first cylinder drum 3*a* is surrounded by a first cylinder drum housing 13*a*. The first cylinder drum 3*a* is supported in the first cylinder drum housing 13*a* by means of a first radial bearing 14*a*.

At the side of the first cylinder drum 3*a* opposite to the first swash plate 8*a* a first port plate 15*a* is located having a through going opening 16*a* for each first pressure chamber 5*a*. The first port plate 15*a* contacts a first valve plate 17*a*. The valve plate 17*a* has kidney-shaped openings serving as inlet and outlet openings for a first pump unit formed by said first rotor 3*a*, said first pressure chamber 5*a*, said first swash plate 8*a*, said first slide shoe 9*a*, said first pressure plate 10*a*, said first sphere 12*a*, said first port plate 15*a* and said first valve plate 17*a*.

The pump device 1 comprises furthermore a second pump unit which is constructed similar to the first pump unit, i.e. comprising a second cylinder drum 3*b*, second pressure chambers 5*b* each formed of a second cylinder 6*b* and a second piston 7*b*. The second piston 7*b* is driven by a second swash plate 8*b*. Each second piston 7*b* is provided with a second slide shoe 9*b* and is held in contact at the swash plate 8*b* by means of a second pressure plate 10*b* swiveling during operation around a second swivel 11*b*. To this end the second pressure plate 10*b* is supported on a second sphere 12*b*. The second cylinder drum 3*b* is surrounded by a second cylinder drum housing 13*b* and supported in the second cylinder drum housing 13*b* by means of a second radial bearing 14*b*.

The second cylinder drum 3*b* is provided with a second port plate 15*b* having a through going opening 16*b* for each pressure chamber 15*b*. The port plate 15*b* cooperates with a second valve plate 17*b* having the same construction as the first valve plate 17*a*.

The first swash plate 8*a* and the second swash plate 8*b* have opposite inclination. During rotation of the shaft 2 the first piston 7*a* and the second piston 7*b* move almost simultaneously in opposite directions keeping resulting forces small. The swash plates 8*a*, 8*b* can have the same angle of indication. However, it is also possible to have different angles of indication of the swash plates 8*a*, 8*b*.

A port housing 18 is located between the first cylinder drum 3*a* and the second cylinder drum 3*b*. The port housing 18 accommodate a common inlet port and a common outlet port for the two pump units. Since the two pistons 7*a*, 7*b* are permanently moving in opposite direction the port housing 18 is loaded by opposite acting pressures. Therefore, the port housing 18 is balanced.

As mentioned above, the two cylinder drums 3*a*, 3*b* are fixed on the shaft 2 in rotational and in axial direction. To define a predetermined distance between the two cylinder drums 3*a*, 3*b* in axial direction, a distance sleeve 21 is located between the first cylinder drum 3*a* and the second cylinder drum 3*b*. Both cylinder drums 3*a*, 3*b* contact the distance sleeve 21.

The first cylinder drum 3*a* is provided with a cone-shaped opening 24*a* surrounding the shaft 2. A ring 25 which is provided with an axial running slot (not shown) and having a cone-like outer form, is mounted on the shaft 2 and inserted in the opening 24*a*. The ring 25 is pressed in the cone-shaped opening 24*a* by means of a pressing sleeve 26 which is screwed onto shaft 2. To this end shaft 2 is provided with an outer threading 27 at its end.

A similar construction can be used for the second rotor 3*b* having a cone-shaped opening 24*b* as well surrounding shaft 2. A slotted ring 28 is held in its position by a shoulder 29 on shaft 2. When the tightening sleeve 26 is tightened the stop member 29 presses the slotted ring 28 into the cone-shaped opening 24*b* thereby clamping the second cylinder drum 3*b* on shaft 2.

Other possibilities for connecting the shaft 2 and the cylinder drums 3*a*, 3*b* are the use of a polygon shape outer contour of the shaft 2 in a section which is surrounded by a cylinder drum 3*a*, 3*b*. Such a polygon shaped outer contour could, for example, be in form of a triangle having rounded edges. The corresponding cylinder drum 3*a*, 3*b* is provided with a corresponding inner contour. It is possible to locate a sleeve made of plastic material between the shaft 2 and the cylinder drum 3*a*, 3*b*. The material for this sleeve can be selected from the group of high-strength thermoplastic material on the basis of polyaryl ether ketones, in particular polyether ether ketones, polyamides, polyacetals, polyaryl ethers, polyethylene terephtalates, polyphenylene sulphides, polysulphones, polyether sulphones, polyether imides, polyamide imide, polyacrylates, phenol resins, such as novolak resins, or similar substances, and as fillers, use can be made of glass, graphite, polytetrafluoro-ethylene or carbon, in particular in fibre form. When using such materials, it is likewise possible to use water as the hydraulic fluid.

Furthermore, it is possible to use a spline connection between the shaft 2 and the cylinder drum 3*a*, 3*b*.

The two cylinder drums 3*a*, 3*b* can be fixed on the shaft 2 in the same way.

It is clear that one cylinder drum 3*a* can be fixed on shaft 2 by a polygonal geometry. The other cylinder drum 3*b* can be clamped on the shaft 2. In principle all combinations are possible.

Figure 2:
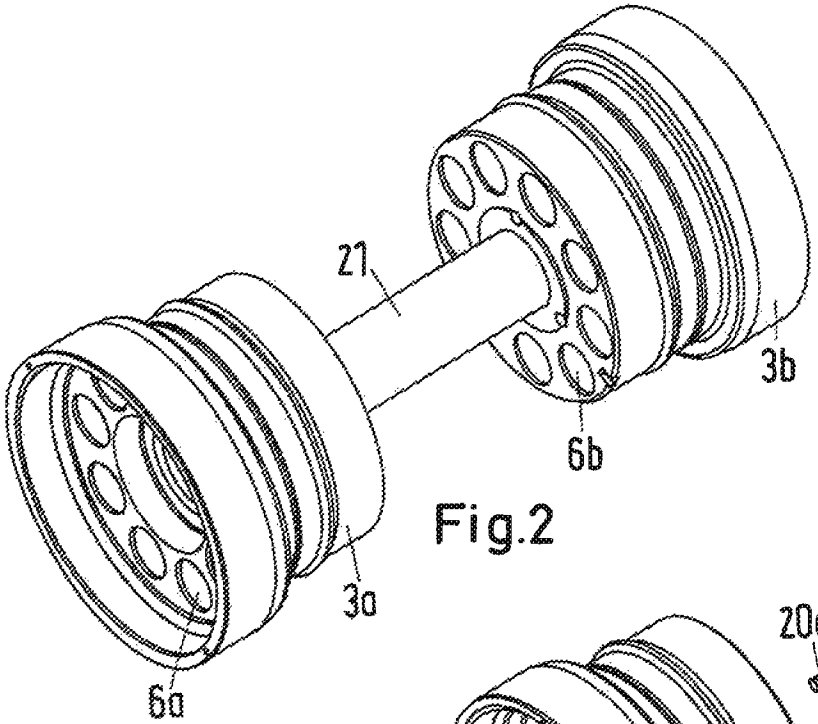
FIG. 2 is a combination of two cylinder drums.
Figure 3:
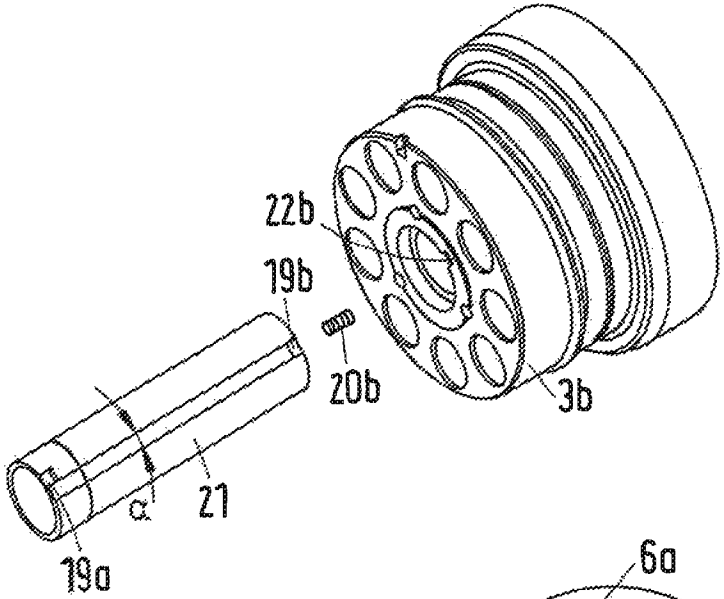
FIG. 3 shows the combination of FIG. 2 in exploded view.
Figure 4:
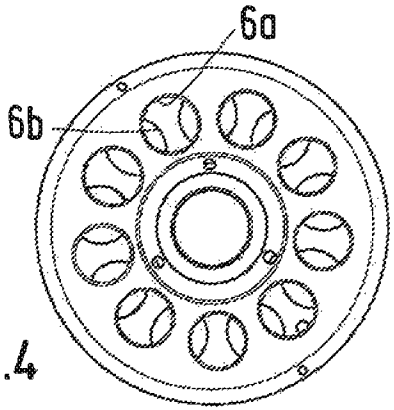
FIG. 4 shows the relation between cylinders of the two cylinder drums.

The cylinder drums 3*a*, 3*b* are offset with respect to each other in rotational direction. This is shown in FIGS. 2 to 4. It is apparent that the cylinder drums 3*a*, 3*b* have the same number of cylinders. In the present case, each cylinder drum 3*a*, 3*b* has 9 cylinders 6*a*, 6*b*. The two cylinder drums are identical.

As explained above, the movement of the piston in the cylinder in one direction generates an increasing pressure whereas the movement of the piston in the opposite direction causes a decreasing pressure. The rotation of one cylinder drum 6*a* or 6*b* therefore produces pressurized liquid having an undulation with 9 peaks in one revolution.

As can be seen in FIG. 4, the two cylinder drums 3*a*, 3*b* are offset with respect to each other in rotational direction by half of the angular distance between two cylinders 6*a*, or precisely by the angular distance between the two center points or center axises of the cylinder 6*a* of the cylinder drum 3*a*. More generally speaking the two cylinder drums 3*a*, 3*b* are offset to each other by an angle $\alpha=360°/(N*n)$, wherein N is the numbers of cylinders in each cylinder drum and n is the number of cylinder drums 3*a*, 3*b*. In the present case there are two cylinder drums 3*a*, 3*b* and 9 cylinders 6*a*, 6*b* in each cylinder drum 3*a*, 3*b*. Therefore, the angular offset between the two cylinder drums 3*a*, 3*b* is 20°.

This angular offset can easily be adjusted using the clamping means shown in FIG. 1. However, in order to maintain the angular offset the sleeve 21 is provided with a first engagement geometry 19*a* at one end facing the first cylinder drum 3*a* and with a second engagement geometry 19*b* at the end facing the second cylinder drum 3*b*. The engagement geometries 19*a*, 19*b* are simply formed by recesses having in direction of rotation a distant defined by the above mentioned angle $\alpha$.

A pin 20*a* is inserted into recess 19*a* and a pin 20*b* is inserted into recess 19*b*. The cylinder drums 3*a*, 3*b* each have a bore 20*b* (visible only in cylinder drum 3*b*) accommodating the end of the pin 20*b* protruding out of the recess. The term "bore" is to be construed broadly. It can be formed by any recess limiting a movement of the pin 20*b* in circumferential or rotational direction.

The sleeve 21 is in particular useful when using clamping means for fixing the two cylinder drums 3*a*, 3*b* to the shaft 2. Even when one clamping means becomes loose the angular offset of the two cylinder drums 3*a*, 3*b* is maintained, because the sleeve 21 keeps this angular offset or angular distance.

When a spline connection is used, it is preferred that the spline connection has a number of splines corresponding to the total number of cylinders of said cylinder drums. In the present case such a spline connection should have at least 18 spline or an integer multiple of these 18 splines. The two cylinder drums 3*a*, 3*b* are mounted on the splines with one spline distance or one spline offset.

When a polygon outer contour is used, the shaft must have a corresponding offset between the two polygon outer contours.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A pump arrangement comprising:

a driving shaft, cylinder drum means fixed to said shaft in rotational direction and having a plurality of cylinders, and a piston in each cylinder, each piston having a slide shoe in contact with driving surface means, wherein said cylinder drum means comprise at least a first cylinder drum and a second cylinder drum, said cylinder drums being fixed to said common shaft in a rotational direction, wherein the cylinder drums are offset with respect to each other in the rotational direction;

wherein a sleeve is arranged between said cylinder drums, said sleeve coupling said cylinder drums in the rotational direction;

wherein said sleeve is in direct contact with the first cylinder drum and the second cylinder drum; and wherein the rotational direction is about a rotational axis, and the cylinder drums are offset with respect to each other in the rotational direction such that center points of a first set of cylinders of the plurality of cylinders in the first cylinder drum are not aligned in an axial direction with center points of a second set of cylinders of the plurality of cylinders in the second cylinder drum, wherein the axial direction is parallel with the rotational axis.

2. The pump arrangement according to claim 1, wherein said cylinder drums have the same number of cylinders.

3. The pump arrangement according to claim 2, wherein said cylinder drums are identical.

4. The pump arrangement according to claim 3, wherein said cylinder drums are offset to each other by an angle $\alpha=360°/(N*n)$ wherein N is the number of cylinders in each cylinder drum and n is the number of cylinder drums.

5. The pump arrangement according to claim 4, wherein said first cylinder drum and said second cylinder drum are located on opposite sides of a port housing.

6. The pump arrangement according to claim 4, wherein at least one of said cylinder drums is fixed to said shaft by a clamp.

7. The pump arrangement according to claim 3, wherein said first cylinder drum and said second cylinder drum are located on opposite sides of a port housing.

8. The pump arrangement according to claim 3, wherein at least one of said cylinder drums is fixed to said shaft by a clamp.

9. The pump arrangement according to claim 2, wherein said first cylinder drum and said second cylinder drum are located on opposite sides of a port housing.

10. The pump arrangement according to claim 2, wherein at least one of said cylinder drums is fixed to said shaft by a clamp.

11. The pump arrangement according to claim 2, wherein at least one of said cylinder drums is fixed to said shaft by a spline connection.

12. The pump arrangement according to claim 1, wherein said first cylinder drum and said second cylinder drum are located on opposite sides of a port housing.

13. The pump arrangement according to claim 12, wherein at least one of said cylinder drums is fixed to said shaft by a clamp.

14. The pump arrangement according to claim 1, wherein at least one of said cylinder drums is fixed to said shaft by a clamp.

15. The pump arrangement according to claim 1, wherein at least one of said cylinder drums is fixed to said shaft by a spline connection.

16. The pump arrangement according to claim 15, wherein said spline connection comprise a number of splines corresponding to the total number of cylinders of said cylinder drums.

17. The pump arrangement according to claim 1, wherein said shaft has a first polygon outer contour inserted in said first cylinder drum and a second polygon outer contour inserted in said second cylinder drum, said polygon outer contours being offset in the rotational direction.

18. The pump arrangement according to claim 1, wherein said sleeve comprises a first engagement geometry at one end and a second engagement geometry at the other end, said first engagement geometry meshing with said first cylinder drum and said second engagement geometry meshing with said second cylinder drum, said first engagement geometry being offset to said second engagement geometry in the rotational direction.

19. The pump arrangement according to claim 18, wherein said engagement geometries each comprise at least a recess wherein a pin is inserted into said recess and in a bore of each of said cylinder drums.

20. The pump arrangement according to claim 1, wherein said sleeve is a tubular member that surrounds said driving shaft.

* * * * *